United States Patent [19]

Charles

[11] 4,306,504

[45] Dec. 22, 1981

[54] RAILROAD RERAILER

[76] Inventor: Leslie E. Charles, Rte. 1 Dobson Rd., Sugar Valley, Ga. 30746

[21] Appl. No.: 141,940

[22] Filed: Apr. 21, 1980

[51] Int. Cl.[3] ..... B61K 5/00

[52] U.S. Cl. ..... 104/264; 238/2; 238/17

[58] Field of Search ..... 104/262, 264, 265, 266–274; 238/2, 283, 17

[56] References Cited

U.S. PATENT DOCUMENTS

| | | | |
|---|---|---|---|
| 137,694 | 4/1873 | Latimer | 104/264 |
| 349,783 | 9/1886 | Campbell | 104/264 |
| 367,967 | 8/1887 | Dwight | 104/264 |
| 388,122 | 8/1888 | Childs | 104/264 |
| 410,222 | 9/1889 | Tilden | 104/264 |
| 762,176 | 6/1904 | Lockwood | 104/264 |
| 1,152,784 | 9/1915 | Bowman | 104/264 |
| 1,591,875 | 7/1926 | Myers | 104/264 |
| 3,784,097 | 1/1974 | Landis | 238/283 |

*Primary Examiner*—Richard A. Bertsch

*Attorney, Agent, or Firm*—Jones, Thomas & Askew

[57] ABSTRACT

A stationary railroad rerailing apparatus for rerailing derailed cars while the train is moving, including V-shaped centering rails between the track rails, an inclined pad of a cushioning, penetrable material, such as asphalt-aggregate material, for raising the derailed car, rigid wedges outside the track rails for cooperating with the inclined pad to raise the derailed car wheels above the level of the track rails, and platform members outside the track rails for carrying the wheels of the derailed car above the level of the track rails until they are shifted by the centering rails over the track rails and into a rerailed position. The novel pad material allows the derailed car to be guided and replaced into proper position in a controlled manner.

5 Claims, 6 Drawing Figures

RAILROAD RERAILER

TECHNICAL FIELD

The present invention relates to apparatus for rerailing derailed railroad cars, and more particularly relates to stationary rerailers for rerailing derailed cars without interrupting forward motion of the train.

BACKGROUND ART

It is not uncommon for railroad cars which are being pulled along a railroad track to become derailed as the result of the cars rocking back and forth on the railroad tracks until one or more of the cars rocks off the track. Such rocking of the railroad cars typically reaches its maximum when the train reaches a speed of about eighteen miles per hour. Once the car is off the tracks, it is likely to continue to be pulled by the train without detection by the personnel operating the train for some distance, by riding along the ties and the gravel ballast between the ties. Such a derailed car rides roughly, particularly at road crossings, and is likely to bounce out of coupling with the adjacent cars. A more serious derailment can also occur if a derailed car being carried along by the train passes through a switch.

In the past, apparatus has been disclosed for the purpose of providing a means for guiding derailed railroad cars back onto the rails of a railroad track without stopping the train. For example, the apparatus shown in U.S. Pat. No. 349,783 includes ramps for raising the wheels of a derailed car to the level of the top of the track rails and flanges for guiding the car back into lateral alignment with the track rails. However, the ramps appear to be formed of rigid surfaces and appear to have multiple metal sections that must be fastened in place in relation to the track rails by relatively complex fastening means, and to be supported by means sufficient to carry the weight of the railroad cars. By providing a rigid ramp surface, such prior art devices do nothing to damp or prevent the bouncing of a derailed car. When a bouncing car reaches the level of the ramp at the height of the track rails, there is a risk that the car will bounce off the track rails or bounce out of its couplings altogether.

SUMMARY OF THE INVENTION

The present invention solves the above-described problems of prior art rerailers by providing an inexpensive, easily constructed apparatus that raises derailed cars to the level of the track rails in a controlled manner. Generally described, the invention is an apparatus for rerailing derailed railroad cars onto a railroad track having a pair of parallel track rails, comprising means for centering the derailed cars with respect to the track rails, and an inclined pad for raising the derailed cars above the track rails for repositioning thereon by the centering means, the inclined pad providing a cushioned, penetrable surface for raising the derailed cars in a controlled manner. The preferred pad according to the present invention comprises an asphalt-aggregate material of the type used to pave highways.

The centering means preferably includes a pair of inner rail sections mounted between the track rails, the inner rails each being attached at one end thereof in spaced apart relation to one of the track rails and diverging from the track rails to meet the other inner rail to form a "V" situated between the track rails, and a pair of platforms positioned adjacent to the outer sides of the track rails at least as high as the track rails and extending from the ends of the inner rails where they are attached to the track rails for a portion of the length of the inner rails. The apparatus can also include rigid wedges positioned adjacent to the outer sides of the track rails to provide ramps up to the platform means intermediate the ends of the inner rails, the lower portion of such wedges being covered by the inclined pad of asphalt-aggregate material.

It will thus be seen that the inclined pad according to the present invention provides a cushioning surface into which the flanges of the wheels of the derailed cars can cut so as to prevent bouncing of the derailed cars and damp the motion thereof as they are raised to a position for passing over the track rail into proper alignment. Because of the flexible and penetrable nature of the inclined surface provided according to the present invention, no bouncing of the derailed cars occurs when such cars engage the rerailing apparatus of the present invention, and the derailed cars are therefore guided into proper alignment with the track rails in a controlled manner.

Thus, it is an object of the present invention to provide an improved stationary rerailer for automatically rerailing derailed cars being carried along with a train.

It is a further object of the present invention to provide a rerailing apparatus that is inexpensive to construct and install, and which guides derailed cars into position for rerailing in a controlled manner.

It is a further object of the present invention to provide a rerailing apparatus including an inclined pad-like ramp for providing a cushioned, penetrable surface for raising derailed cars above the track rails in a controlled manner without bouncing of the cars along the inclined surface.

Other objects, features and advantages of the present invention will become apparent upon reading the following detailed description of an embodiment of the invention when taken in conjunction with the drawing and the appended claims.

DETAILED DESCRIPTION

Figure 1:
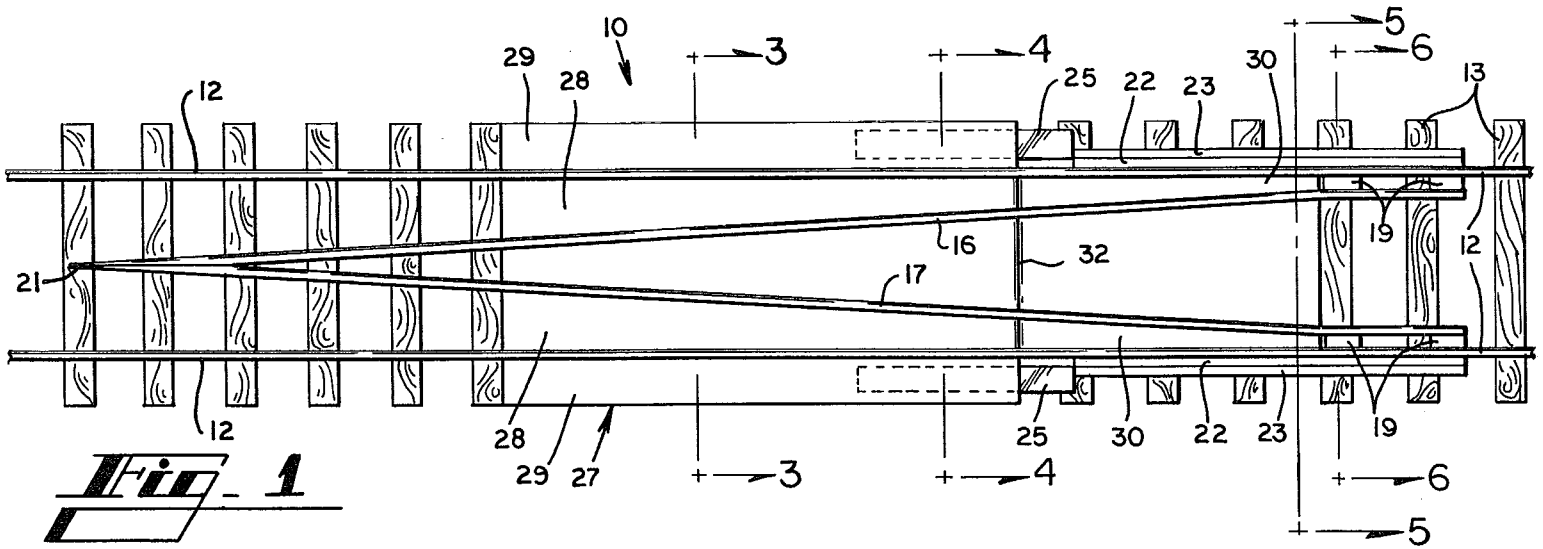
FIG. 1 is a top plan view of a rerailer apparatus embodying the present invention, installed in relation to railroad tracks.

Referring now in more detail to the drawing, in which like numerals represent like parts throughout the several views, FIG. 1 shows a plan view of a rerailer apparatus 10 embodying the present invention. The rerailer apparatus 10 is installed with respect to a pair of track rails 12 which are installed for normal travel of railroad trains thereon prior to installation of the rerailer apparatus 10. The track rails 12 are mounted in conventional fashion upon crossties 13 that are embedded in a bed 14 of gravel or ballast.

The rerailer apparatus 10 includes a pair of inner rail sections 16 and 17 that preferably comprise lengths of rail identical in construction with the track rails 12. However, it should be understood that the inner rail sections 16 and 17 can also comprise flanges of other shapes and materials capable of guiding a derailed car in the manner described hereinbelow.

Figure 6:
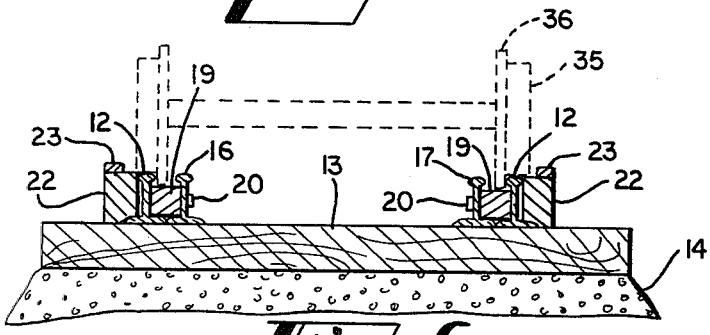
FIG. 6 is a cross sectional view of the rerailer apparatus shown in FIG. 1, taken along line 6—6 of FIG. 1, and showing in dotted lines the final position of a truck of a formerly derailed car.

The inner rail sections 16 and 17 are each attached at one end thereof in spaced apart relation to one of the track rails 12 by placing heel blocks 19 between the inner rail section and the track rail and bolting the assembly together with bolts 20 as shown in FIG. 6. The inner rail sections 16 and 17 are attached to their respective track rails 12 opposite one another and extend parallel to the track rails 12 for a short distance and are again attached to their respective track rails 12 in spaced relation therefrom by a second set of heel blocks 19. In the preferred embodiment, the length of the portions of the inner rail sections parallel to the track rails 12 is about four feet. From their second point of attachment to the track rails 12, the inner rail sections 16 and 17 each extend along the space between the track rails 12 and diverge from the track rails 12 to form the shape of a "V" until the inner rail sections meet at point 21. In the preferred embodiment shown, the total length of each of the inner rail sections from the heel blocks 19 to the point 21 is about forty feet, but such length may be varied so long as the lateral movement of a derailed car being guided by one of the inner rail sections is not too abrupt, for reasons that will become apparent from the continuing description of the invention.

Figure 5:
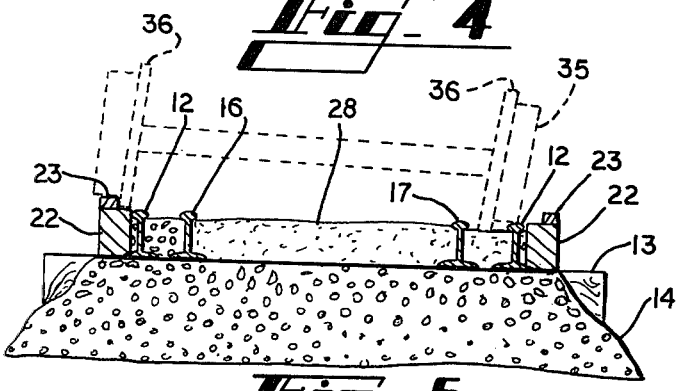
FIG. 5 is a cross sectional view of the rerailer apparatus of FIG. 1, taken along line 5—5 of FIG. 1, and showing in dotted lines the position of a truck of a derailed car.

A pair of platform members, preferably comprising conventional rectangular crossing timbers, are positioned adjacent to the outside of each of the track rails 12, beginning at the ends of the inner rail sections 16 and 17 where they are attached to the track rails 12, and extending toward the point 21 for a portion of the length of the inner rail sections 16 and 17. The length of the platform members 22 in the preferred embodiment shown is about eleven feet. The height of the platform members 22 is at least as high as the upper surface of the track rails 12, and preferably is about one inch above the track rails 12. Mounted to the outside edge of each of the platform members 22 is an elongate strip 23. that also can be made of wood. The purpose of the strips 23 is to elevate the wheel of a railroad car travelling along the platform member 22 to allow the flange 36 of the wheel to slide across the track rail 12. The strips 23 are preferably mounted on the platform members 22 to provide a three inch surface on the platform members between the strips 23 and the track rails 12. The height of the strips 23 is approximately equal to the extension of the flange 36 of a railroad car wheel beyond the circumference of the main body of the wheel, as best shown in FIG. 5.

Figure 2:
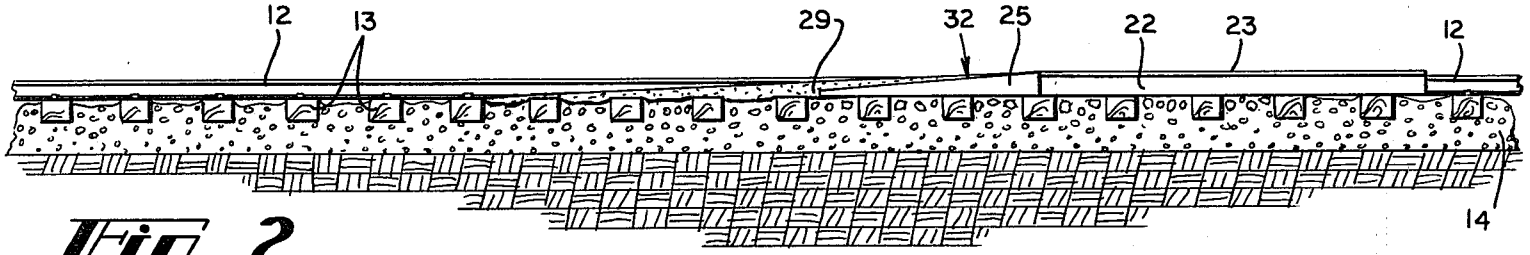
FIG. 2 is a side view of the rerailer apparatus shown in FIG. 1.

At the end of each of the platform members 22 closest to the point 21, a rigid wedge 25 is positioned in spaced apart parallel relation to the outside edge of the track rails 12, preferably about three inches from the track rails 12, to provide an inclined surface leading from the level of the strips 23 downwardly for another portion of the length of the inner rail sections 16 and 17, as shown in FIG. 2. In the preferred embodiment shown, the rigid wedges 25 are about six feet long, and slope downwardly to a height about one inch above the level of the crossties 13.

Installation of the rerailer apparatus 10 is completed by the addition of an inclined pad 27. The pad 27 is preferably an asphalt-aggregate material that is poured into place in various sectors 28, 29 and 30. A pair of sectors 28 fill a portion of the area between each of the track rails 12 and the inner rail sections 16 and 17, beginning at a line 32 running transverse to the track rails 12 about two-thirds of the way up the rigid wedges 25, and extending therefrom in a downward incline to reach the level of the crossties 13 about half way between the line 32 and the point 21 where the inner rail sections join. Another pair of asphalt-aggregate sectors 29 have the identical slope and length of the sectors 28, but the sectors 29 lie outside of the track rails 12 and cover about two-thirds of the rigid wedges 25, as shown in FIG. 2. A final pair of asphalt-aggregate sectors 30 are flat and fill the space between the track rails 12, the inner rail sections 16 and 17, the line 32, and the heel blocks 19, as shown in FIGS. 1 and 5.

The function of the rerailer apparatus 10 is to replace upon the track rails 12 a derailed car being carried along with the train with the wheels on one side of the car being outside of one of the track rails 12, and the wheels on the other side of the car being between the track rails 12. As the derailed car approaches the rerailer apparatus 10, the wheels of the car between the track rails 12 will pass into the area between one of the inner rail sections 16 or 17, and eventually the inner side of such wheels will engage the inner rail section and begin to be guided back toward a centered position over the track rails 12. For purposes of description of the operation of the invention, it will be assumed that a car is derailed to the left of the track rails 12 in FIGS. 3–6, and therefore that the wheels of the car between the track rails 12 will engage the inner rail section 17.

Figure 3:
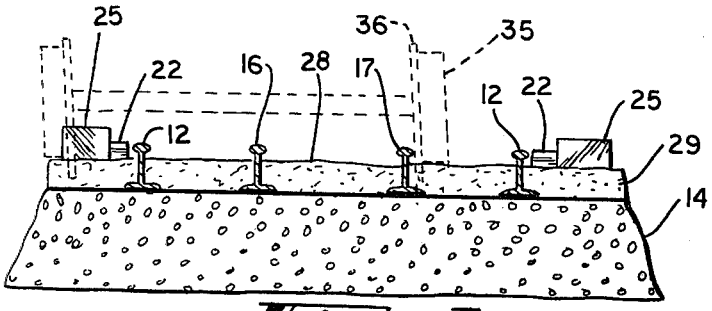
FIG. 3 is a cross sectional view of the rerailer apparatus shown in FIG. 1, taken along line 3—3 of FIG. 1, and showing in dotted lines the position of a truck of a derailed car.

The progress of a truck 35 of a derailed car engaging the rerailing apparatus 10 is shown sequentially in FIGS. 3–6, where the truck 35 is shown in dotted lines. As the derailed car engages the inclined pad 27, the weight of the car causes its wheels, and particularly the flange 36 that extends beyond the outer circumference of the wheels, to cut into the surface of the pad. The non-rigid and penetrable nature of the asphalt-aggregate material comprising the pad 27 causes any bouncing movement of the derailed car to be damped and cushioned so that the derailed car moves up the inclined pad 27 in a controlled manner. Although the wheels and flanges of the derailed car cut into the asphalt-aggregate material, shifting and compressing it, the asphalt-aggregate material is sufficiently strong to support the derailed car after compression by the weight of the car, so that the car does begin to rise as it moves along the pad 27, as shown in FIG. 3.

Figure 4:
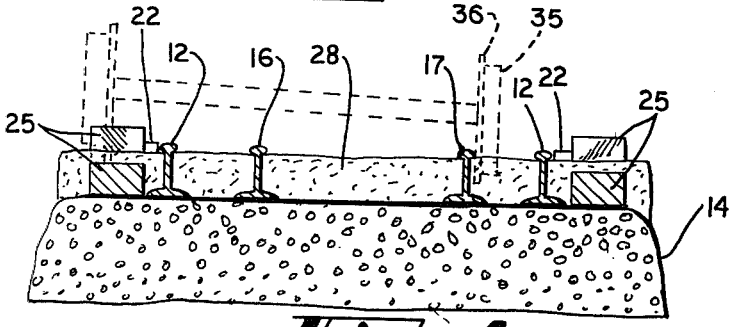
FIG. 4 is a cross sectional view of the rerailer apparatus of FIG. 1, taken along line 4—4 of FIG. 1, and showing in dotted lines the position of a truck of a derailed car.

When the wheels of the derailed car reach the position shown in FIG. 4, the wheels outside the track rails 12 have engaged the inclined surface of the rigid wedge 25, which assists the pad 27 in raising such outer wheels to a level at which they can be laterally shifted over the track rail 12. It should be noted that the rigid wedge 25 is partially covered with the pad material in the sector 29 so that a damping effect is exerted upon the movement of the derailed car even after it has engaged the solid inclined surface of the wedge 25. At this time, the wheels of the derailed car that are between the track rails 12 are still travelling through and being raised by the pad material in the sector 28 between the track rail 12 and the inner rail section 17. In the position shown in FIG. 4, the derailed car has been shifted laterally toward a centered position with respect to the track rails 12 because the inner wheels of the derailed car have been bearing against the inner rail section 17 and have been guided thereby as the inner rail section 17 approaches closer to the track rail 12.

Upon reaching the end of the rigid wedge 25, the exterior wheels of the derailed car pass onto the strip 23 and have been raised to a height slightly above the adjacent track rail 12. At the same time, the wheels of the derailed car between the track rails 12 have passed onto the level sector 30 of the pad 27 filling the narrow space between the inner rail section 17 and the track rail 12. Because of the confined space between the inner rail section and the track rail, the asphalt-aggregate material in the sector 30 becomes quickly compressed under the weight of the car and therefore tends to support the wheels of the car at the surface of the asphalt-aggregate material, which in the sector 30 is poured to the level of the uppermost extent of the track rails 12.

Thus, the lateral centering of the derailed car by the inner rail section 17 shifts the main body of the wheel that had been between the track rails 12 onto the track rail 12 adjacent to the centering inner rail section 17. This action also draws the wheels riding on the strip 23 across the opposite track rail 12 and into rerailed position as the wheels of the car leave the pad 27 at the location of the heel blocks 19, as shown in FIG. 6. Having now been replaced properly on the track rails 12, the car poses no further danger of a major derailment at road crossings, switches and the like where safe passage requires that all of the cars be properly placed on the trail rails.

Of course, the above-described rerailer apparatus 10 operates to replace derailed cars upon the tracks without stopping the train for complicated jacking and shifting operations that are commonly used to rerail derailed cars. Furthermore, the stationary rerailer apparatus 10 according to the present invention accomplishes rerailing in a more highly controlled manner than that of prior art stationary rerailers by providing a novel inclined pad for cushioning the motion of the derailed car as it is being raised and centered for replacement onto the track rails. The operation of the apparatus 10 is factilitated by the cooperation between the rigid wedges 25 and the overlaying pad material. It will be understood that although the pad 27 is disclosed in the preferred embodiment as comprising asphalt-aggregate material, other materials having the same properties of penetrability and compressibility under the weight of a derailed car, while being able to support the weight of the car after some compression, can be utilized for the pad material. It is preferable that such a material be suitable for pouring into the various sectors forming the pad 27 for ease of installation.

Other economies of construction can be realized in installing the rerailer apparatus 10 according to the present invention by using scrap rails to form the inner rail sections 16 and 17, and by using wooden crossing timbers for the platform members 22 and other wooden parts for the strips 23 and the rigid wedges 25.

The description of the preferred length of the inner rail sections hereinabove will become clear upon consideration of the cooperation between the inner rail sections and the material of the pad 27. If the length of the inner rail sections is too short, the lateral movement of the derailed car caused by the inner rail sections will be too rapid, causing a plowing of the wheels through the asphalt-aggregate material of the pad 27. Therefore, the length of the inner rail sections, and thus the rate at which they diverge form the track rails 12, should be selected in connection with the composition of the pad material so that the flanges and portions of the derailed car wheels that cut into the pad material are guided through the material and not plowed through the material at a rate that could excessively tear up the pad 27.

It will be understood that a bidirectional rerailer apparatus embodying the invention can be constructed by duplicating the apparatus described hereinabove from the point where the pad sector 30 reaches the heel blocks 19 to the point 21 at the juncture of the inner rail sections, and placing such structure to extend along the track rails 12 in the opposite direction from the apparatus shown in the drawing.

While this invention has been described in detail with particular reference to a preferred embodiment thereof, it will be understood that variations and modifications can be effected within the spirit and scope of the invention as described hereinbefore and as defined in the appended claims.

I claim:

1. An apparatus for rerailing derailed railroad cars onto a railroad track having a pair of parallel track rails, comprising:

diverging guide rails positioned between the track rails for urging the wheels of derailed railroad cars toward alignment with the track rails;

a pair of wedge means each positioned outside a track rail adjacent the diverging ends of said guide rails for raising the wheels of a derailed railroad car above the track rails for repositioning thereon by said guide rails; and an inclined pad extending along said diverging guide rails comprising penetrable material poured between the track rails and said guide rails and along the outside of the track rails and covering at least a portion of said wedge means;

whereby the wheels of a derailed railroad car tend to penetrate the inclined pad as the wheels are urged by the guide rails toward alignment with the track rails.

2. The apparatus of claim 1, wherein said inclined ramp means comprises asphalt-aggregate material.

3. An apparatus for rerailing derailed railroad cars onto a railroad track having a pair of parallel track rails, comprising:

a pair of inner guide rails mounted between said track rails, said inner guide rails forming with each other an approximate V-shape extending along the track rails with the apex of the V-shape located centrally between the track rails and said inner guide rails diverging laterally toward the track rails;

a pair of platform means positioned adjacent to the outer sides of the track rails at least as high as the track rails and extending from positions adjacent the diverging ends of said inner guide rails for a portion of the length of said inner guide rails toward the apex of said inner guide rails;

a pair of rigid wedge means each positioned adjacent to an outer side of a track rail and each extending from an end of a platform adjacent the apex of the guide rails further along the track rails toward the apex of said guide rails for providing ramps up to said platform means intermediate the ends of said inner guide rails; and inclined ramp means comprising asphalt-aggregate material poured between the track rails and about said inner guide rails at about the height of the track rails from adjacent the diverging ends of said guide rails to a point intermediate the lengths of said wedge means, and thereafter sloping downwardly both between the track rails and outside the track rails, said inclined ramp means covering at least a lower portion of said wedge means.

4. The apparatus of claim 3 wherein said inner rails are held in spaced apart relation to said track rails by heel blocks.

5. The apparatus of claim 4 wherein said platform means comprise wooden crossing timbers and elongate strips mounted along the outer edges of said crossing timers, and wherein said wedge means are wooden wedges.

* * * * *